United States Patent [19]

Hassan et al.

[11] 4,257,637

[45] Mar. 24, 1981

[54] CONTACTLESS AIR FILM LIFTING DEVICE

[75] Inventors: Javathu K. Hassan, Hopewell Junction; John A. Paivanas, Hyde Park, both of N.Y.

[73] Assignee: International Business Machines Corporation, Armonk, N.Y.

[21] Appl. No.: 79,767

[22] Filed: Sep. 28, 1979

[51] Int. Cl.[3] ..... B66C 1/02

[52] U.S. Cl. ..... 294/64 B; 271/97

[58] Field of Search ..... 294/64 R, 64 A, 64 B, 294/65; 226/97; 271/97, 98, 195; 414/737, 744 B, 752

[56] References Cited

U.S. PATENT DOCUMENTS

| | | | |
|---|---|---|---|
| 3,220,723 | 11/1965 | Rabinow | 271/195 |
| 3,438,668 | 4/1969 | Olsson et al. | 294/64 B |
| 3,466,079 | 9/1969 | Mammel | 294/64 B |
| 3,523,706 | 8/1970 | Logue | 294/64 B |
| 4,029,351 | 6/1977 | Apgar etal. | 294/64 B |

*Primary Examiner*—Johnny D. Cherry

*Attorney, Agent, or Firm*—James R. McBride

[57] ABSTRACT

A contactless air film lift-up device constructed to utilize the pressure-velocity relationship expressed in the Bernoulli principle to provide a desired pick-up action, while at the same time generating a lateral restraining force through a further utilization of the Bernoulli principle.

7 Claims, 9 Drawing Figures

CONTACTLESS AIR FILM LIFTING DEVICE

BACKGROUND OF THE INVENTION

The present invention relates to a device for picking up objects without making physical contact with the object. More particularly, the present invention relates to a device for picking up objects by utilizing a flow of a gas, such as air, without the need for providing lateral restraints to prevent the object from lateral movement.

There are many applications in which it is desired to pick up an object without contacting the object with any mechanical means, such as the fingers or mechanical devices such as prongs or tweezers or the like. For example, semiconductor wafers are particularly susceptible to damage from mechanical contact during handling. One such contactless lifter device is described in U.S. Pat. No. 3,438,668 to Olsson et al. The Olsson et al. patent described a contactless lifter which utilizes the Bernoulli principle to provide a pick-up device that utilizes a flow of a gas, such as air, to provide the pick up force and to provide a cushion between the object being picked up and the pick up device.

The pick up device of the Olsson et al. patent utilizes a plurality of projections around the periphery of the device to provide lateral restraint of the object being picked up. It is undesirable to use such lateral restraints for delicate objects, such as semiconductor wafers, since the object being picked up tends to float on the surface of the pick up device and to impinge upon the lateral restraint projection. Such impingement on the lateral restraint projections can mar on fracture the edge of an undesirable number of the delicate objects upon contact of the object with the restraining projection. The undesirable features of the Olsson et al. patent and other prior art methods for picking up objects are overcome by the present invention which utilizes the same flow of gas used to produce the pick up force to provide a lateral restraining force.

SUMMARY OF THE INVENTION

It is a principal object of the present invention to provide a device which will pick up delicate objects without any contact between the pick up device and the object being picked up, including lateral restraints.

Another object of the present invention is to provide a pick up device that utilizes a flow of gas, such as air, to provide the pick up force, to provide a cushion between the object being picked up and the pick up device and to provide a lateral restraining force to prevent the object being picked up from being moved off center in respect to the flow of gas.

A further object of the present invention is to provide a pick up device that utilizes the Bernoulli principle to provide the pick up force and which further utilizes the Bernoulli principle to provide lateral restraining forces.

Generally, the present invention involves a device constructed to utilize the pressure-velocity relationship expressed in the Bernoulli principle to provide a desired pick up action, while at the same time generating a lateral restraining force through a further utilization of the Bernoulli principle.

In one form of the device, a pick up head is provided with a gas flow boundary surface designed to be disposed adjacent the object that is to be picked up. A first opening is formed in the center of the flow boundary surface, out of which is caused to flow a gas, such as air. When the pick up head is disposed adjacent the object to be picked up, the gas leaving the first opening is caused to change from an axial to a radial direction and the velocity of the air flow is increased as it leaves the opening. Consequently, the pressure adjacent the flow boundary surface in a region down stream from the opening will be decreased to a level below atmospheric pressure. As the flow boundary surface is moved near the surface of an object to be picked up, the pressure further decreases until normal atmospheric pressure is sufficient to cause the object to be moved toward the flow boundary surface and thereby picked up. At the same time, the flowing air provides a cushion to prevent contact of the object being picked up with the gas flow boundary surface of the pick up head.

In the pick up device of the present invention, means are provided which are radially spaced from the first opening for directing a secondary flow of the gas to a second opening adjacent the first opening. The secondary gas flow alters the shape of the low pressure area and provides a frictional force which, in effect, is directed radially inward toward the first opening, and which acts to restrain the object being picked up from lateral movement without the necessity of providing restraining pins or other solid restraining means.

DETAILED DESCRIPTION OF THE INVENTION

Other objects and advantages of the invention will become more apparent from the following detailed description and claims taken with the accompanying drawings in which:

Figure 1:
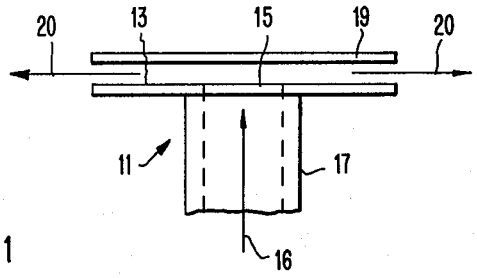
FIG. 1 is a schematic cross section of a prior art pick up device showing the relationship of the object being picked up with the device.

Referring now to FIG. 1, a portion of a prior art pick-up device having a pick-up head 11 is illustrated. Pick-up head 11 has a flow boundary surface 13 which is provided with a central opening 15. A duct 17 carries a gas, such as air, in a direction indicated by arrow 16. The gas in duct 17 passes through opening 15 and is caused to change in direction by the presence of an object to be picked up 19. The air then passes outwardly in the direction indicated by arrow 20 between the object 19 and the flow boundary surface 13.

Figure 2:
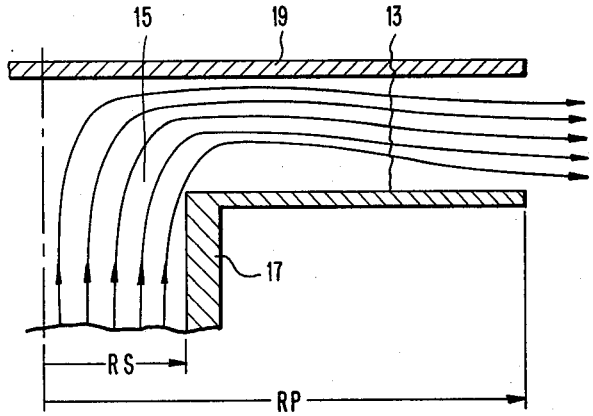
FIG. 2 is an enlarged view of FIG. 1 taken from the center line to the right, showing gas flow lines and the change from axial to radial flow and the resultant low pressure region generated thereby.

The flow pattern for a gas passing through the device shown in FIG. 1 is illustrated in FIG. 2. As shown in FIG. 2 the axial flow of gas in duct 17 is transferred to a radial flow of gas in the space between the flow boundary surface 13 and the object 19. The velocity of the gas is increased in the direction shown by arrow 20 when the flow boundary surface 13 is placed near a complementary surface of an object. Because of the increase in velocity, a low pressure region is formed between the flow boundary surface 13 and the object 19 with the result that the object is urged by atmospheric pressure into the low pressure region and is thus lifted toward the flow boundary surface 13. As the object is picked up from the surface on which it is resting, the air flowing from the opening 15 prevents the object from striking against the flow boundary surface 13 and provides a cushion for the object.

Figure 3:
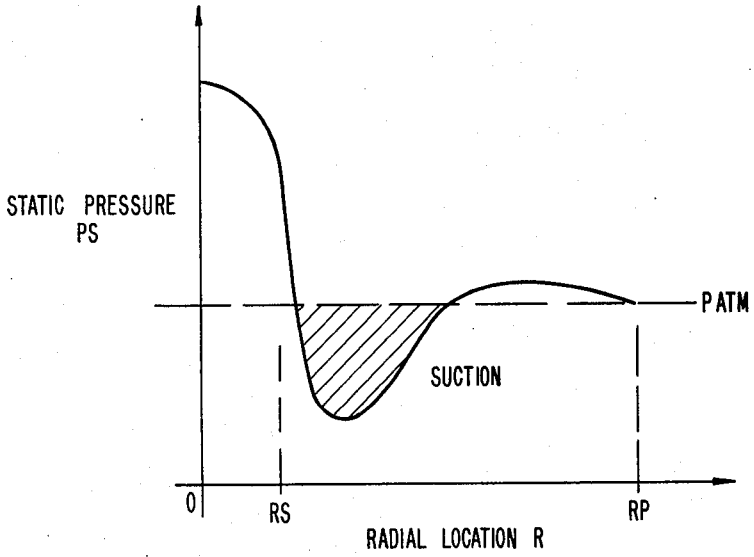
FIG. 3 is a graph showing the relationship of static pressure with radial distance from the center line of the pick up device of FIG. 1.

The general phenomenon described hereinabove is sometimes referred to as the "axi-radial suction phenomenon." As discussed, the incoming axial air flow impinges against an opposing plain surface causing it to abruptly turn to the radial direction. In the process, flow expansion and separation occur with the generation of an accompanying low pressure (suction) region. The relationship of mean static pressure with radial distance is set forth in FIG. 3. As shown, the mean static pressure $p_s$ is below atmospheric pressure $p_{atm}$ over a part of the impingement surface area bounded by radii $r_s$ and $r_p$. The net suction force is the integrated average of the pressure variation over the impingement area where the net suction force is less than atmospheric. This net suction force, denoted by $F_s$, is the integrated area of the curve of FIG. 3 which lies below $p_{atm}$. $F_s$ varies with inlet hole size relative to the impingement area and with the gas supply flow rate.

A basic relationship between three forces is involved: the suction force $F_s$, a momentum repelling force $F_m$ and the weight of the object to be lifted $F_w$. At a given spacing and at a low flow rate, $F_s$ is insufficient to lift the wafer from a support surface. As the flow rate is increased, $F_s$ increases more rapidly than $F_m$ until a condition is reached where attraction occurs. Once the object is held in attraction at some distance, it is essentially free to move laterally because of very low air film friction. For this reason constraining pins have been used in devices based upon the heretofore described axi-radial phenomenon to limit object travel.

Figure 4:
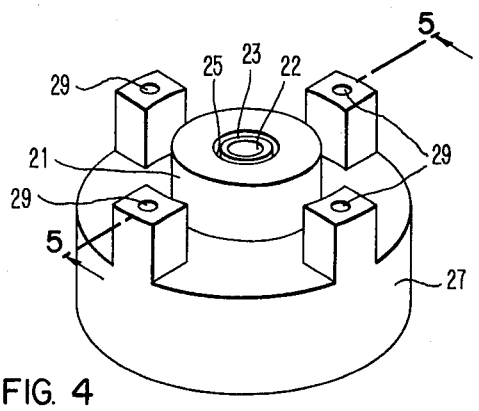
FIG. 4 is a perspective view of a pick up device of the type contemplated in this invention.

The operating principle of the present invention is illustrated in FIG. 4 by one of a number of possible device configurations. In essence, the operating principle consists of utilizing a part of the suction generated by the primary axi-radial forces caused by the change of axial flow to radial flow to pump a secondary air flow from remote radially spaced locations to a second opening located adjacent the central opening 15. The pumped air flow causes intense flow drag at the remote location which acts in a manner to constrain wafer movement in the lateral direction. It is a significant finding of the present invention that a large part of the primary suction region can be used without upset of the general axi-radial suction phenomenon.

Figure 5:
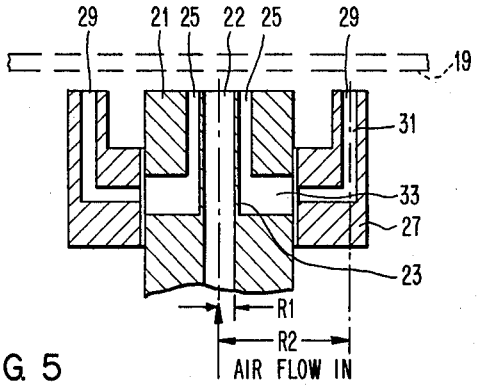
FIG. 5 is a cross-sectional view, partially broken away, of the pick up device of FIG. 4 with the impingement surface of an object shown in phantom outline above the device.

As shown in FIGS. 4 and 5, one embodiment of the lifting device of the present invention comprises a nozzle body 21 and a ring member 27. The nozzle body 21 has a central first opening 22, a gas flow supply tube 23, and an annular second opening 25 surrounding as flow supply tube 23. Ring member 27 is provided with radially spaced ports 29.

As shown in FIGS. 4 and 5, the ring member 27 has four ports 29 radially spaced from central opening 22. The ports are equidistant with respect to the center line of the central opening 22 both radially and angularly. Depending upon the object to be picked up, the ports can be located unequal radial distances and can be spaced nonequidistant angularly. It is preferred, however, to use angular equidistant spacing and equidistant radial locations for the ports. It has been determined that any number of ports greater than two can be used to provide the benefits of the invention.

A nozzle duct 31 in combination with a ring duct 33 provides fluid communication between the ports 29 and the annular second opening 25 to provide the pumping action heretofore described. Since the pressure of the gas at the nozzle port 29 is greater than the pressure of the gas at the annular opening 25 due to the axi-radial suction affect of the principal air flow through the gas flow supply tube 23, the flow of gas is countercurrent to the primary air flow as shown by the arrows in FIG. 5.

Figure 6:
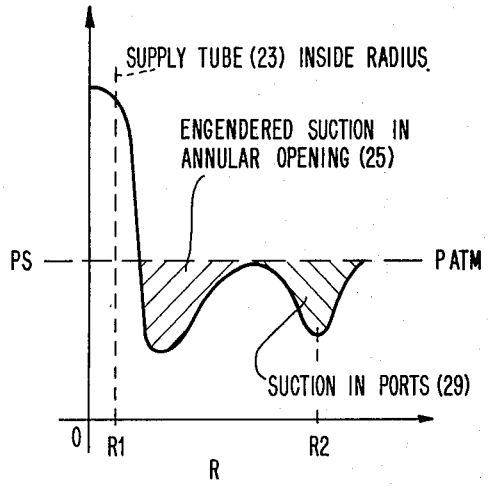
FIG. 6 is a graph showing the relationship of static pressure with radial distance from the center line of the device of FIG. 4.

The contactless lifting device of the invention provides a change in the static pressure relationship between the lifting device and an object 19 to be lifted (shown in phantom outline in FIG. 5). This change in relationship of static pressure is shown in FIG. 6. As seen in FIG. 6 a secondary suction region is setup in the space adjacent to the radially spaced ports 29. This secondary suction region and the flow drag forces created by the countercurrent air flow act to restrain the object and to prevent lateral movement of the object after it has been picked up.

Figure 7:
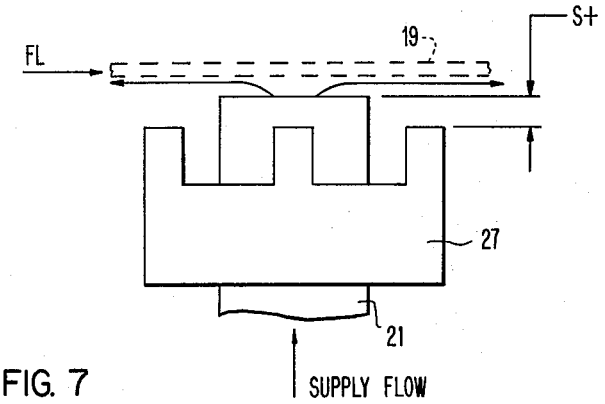
FIG. 7 is a schematic view showing one position of the component parts of the pick up device of the invention.
Figure 8:
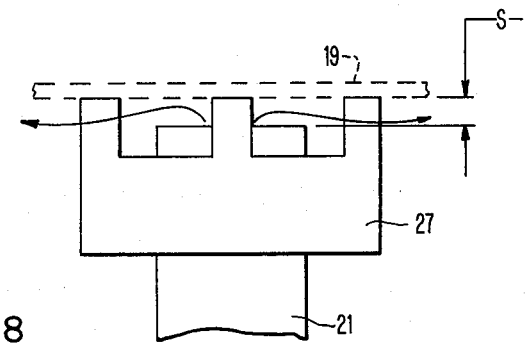
FIG. 8 is a schematic view showing a second position of the component parts of the device of the present invention.

As shown in FIGS. 4 and 5, the nozzle body 21 is in a slidable relationship with the ring member 27. This permits the spacing between the object 19 and the opening of the radially spaced port 29 to be adjusted. For purposes of clarity, a spacing wherein the horizontal plane of port 29 is below the horizontal plane of the first opening 22 in nozzle body 21 is considered a plus spacing, $S^+$. Where the horizontal plane of the port 29 is above the horizontal plane of the opening 22 in nozzle body 21, the spacing is considered minus, $S^-$. These two spacing relationships are shown in FIGS. 7 and 8.

Figure 9:
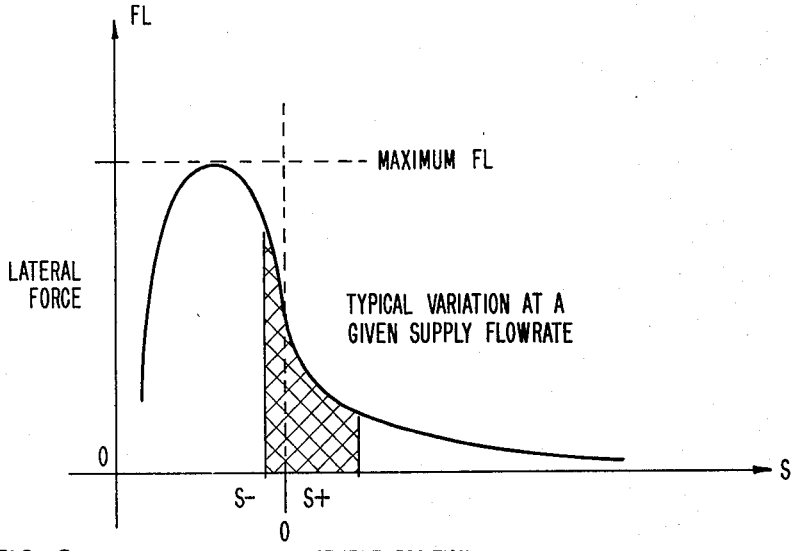
FIG. 9 is a graph showing the relationship of the lateral force for centering of an object with the position of the component parts of the device of the invention.
Figure 1:
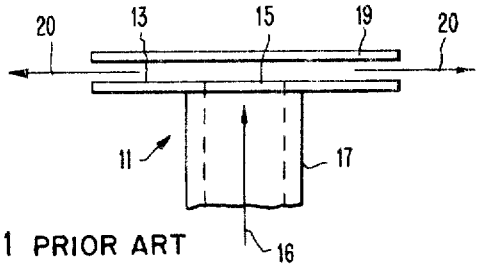
FIG. 1 PRIOR ART
Figure 2:
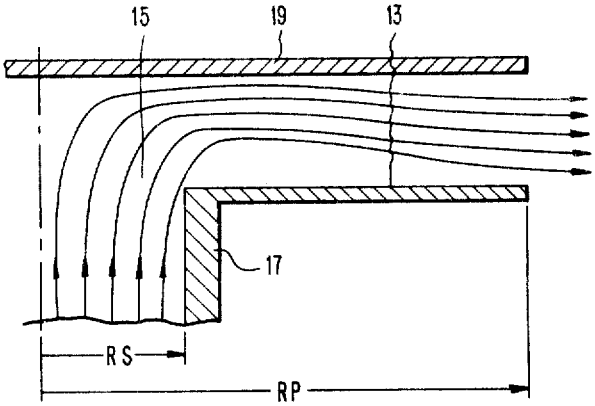
FIG. 2 PRIOR ART
Figure 3:
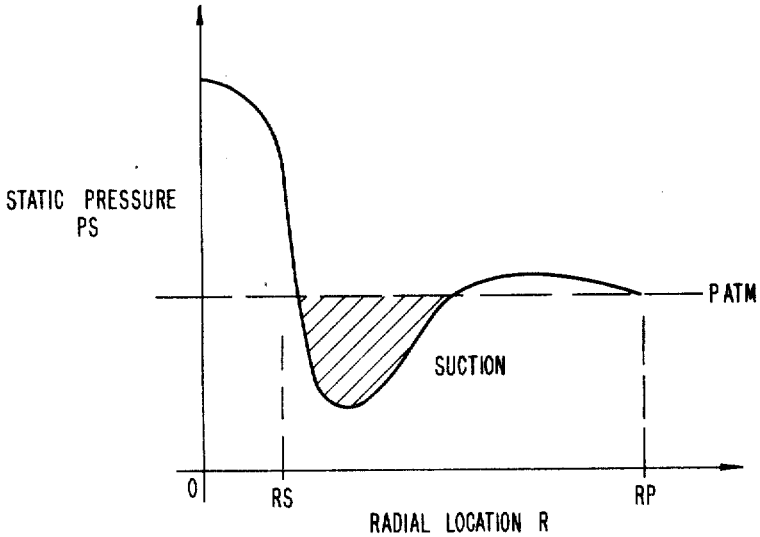
FIG. 3 PRIOR ART
Figure 5:
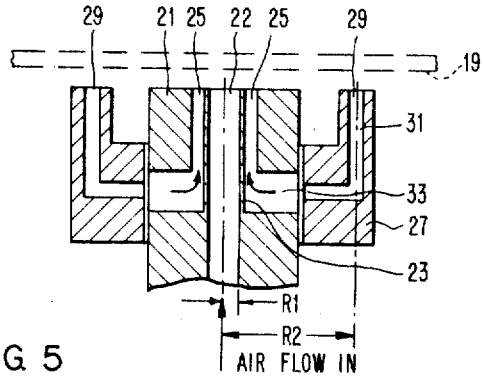

The lateral force generated by the contactless lifting device of the invention is related to the spacing of the ports 29 from the object 19. The relationship of lateral force to spacing is illustrated in FIG. 9. From FIG. 9, it can be seen that the maximum lateral force is generated at an $S^-$ distance. This maximum lateral force occurs when the surface of the port 29 is very close and sometimes in contact with the object 19. It is undesirable to have contact between the port 29 and the object 19. Accordingly, it is preferred to operate at spacing distances within the shaded area of FIG. 9. It should be understood that the relationship of $F_l$ to $S^-$ and $S^+$ is not obsolute and varies with the gas supply flow rate.

The optimum spacing distance for any given configuration of nozzle body 21 and ring member 27 is readily determined by slidable adjustment of ring member 27 in respect to nozzle body 21. Once this optimum spacing has been determined, it is not necessary to manufacture duplicates of the contactless lifting device with separate sliding members and the nozzle body can be constructed from a single piece of material.

It will be appreciated by those skilled in the art that the invention may be carried out in various ways and may take various forms and embodiments other than the illustrated embodiments, heretofore described. The contactless lifting device of the present invention utilizes the axi-radial suction affect to produce both normal and lateral direction control of an object on a gas film. This eliminates the need for constraining impediments to motion of the object and reduces the damage to delicate objects. In particular, it will be appreciated that much simpler device construction is possible. Accordingly, it should be understood that the scope of the invention is not limited by the details of the foregoing description of the preferred embodiments.

Having thus described our invention, what we claim as new, and desired to secure by Letters Patent is:

1. A pick-up device for objects comprising a head having a gas flow boundary surface, a first opening in said surface, a gas supply duct connected to said first opening for conveying a gas to said opening, means radially spaced from said first opening for directing a flow of said gas to a second opening adjacent said first opening whereby an object to be picked up is restrained from lateral movement by gas flow forces without the need to provide radially spaced restraining means as the axi-radial forces of the gas flow create sufficient suction to pick up the object.

2. A pick-up device in accordance with claim 1 wherein said radially spaced means comprises a plurality of radially spaced ports, said ports being in fluid communication with said second annular opening.

3. A pick-up device in accordance with claim 2 wherein said ports are radially spaced equidistant from the center line of said first opening.

4. A pick-up device in accordance with claim 3 wherein said ports have equidistant angular spacing.

5. A pick-up device in accordance with claims 2, 3 or 4 wherein the horizontal plane of said ports is below the horizontal plane of said first opening.

6. A pick-up device in accordance with claims 2, 3 or 4 wherein the horizontal plane of said ports is above the horizontal plane of said first opening.

7. A pick-up device in accordance with claims 2, 3 or 4 wherein the horizontal plane of said ports is coextensive with the horizontal plane of said first opening.

* * * * *

UNITED STATES PATENT AND TRADEMARK OFFICE

CERTIFICATE OF CORRECTION

PATENT NO. : 4,257,637

DATED : March 24, 1981

INVENTOR(S) : Javathu K. Hassan et al.

It is certified that error appears in the above—identified patent and that said Letters Patent is hereby corrected as shown below:

Delete Figures 1-3 and 5 of the drawings and substitute the attached sheet therefore.

Column 3, line 68, "as flow" should read -- gas flow --.

Signed and Sealed this

*Fifteenth* Day of *December 1981*

[SEAL]

*Attest:*

GERALD J. MOSSINGHOFF

*Attesting Officer*

*Commissioner of Patents and Trademarks*